US006698493B2

(12) United States Patent
Graham

(10) Patent No.: US 6,698,493 B2
(45) Date of Patent: Mar. 2, 2004

(54) APPARATUS AND METHOD FOR CASTING A METAL ARTICLE

(75) Inventor: Lawrence D. Graham, Chagrin Falls, OH (US)

(73) Assignee: PCC Airfoils, Inc., Cleveland, OH (US)

( * ) Notice: Subject to any disclaimer, the term of this patent is extended or adjusted under 35 U.S.C. 154(b) by 0 days.

(21) Appl. No.: 10/201,216

(22) Filed: Jul. 23, 2002

(65) Prior Publication Data

US 2004/0016529 A1 Jan. 29, 2004

(51) Int. Cl.[7] ..... B22D 27/04

(52) U.S. Cl. ..... 164/122.1; 164/122.2; 164/338.1

(58) Field of Search ..... 164/122.1, 122.2, 164/338.1

(56) References Cited

U.S. PATENT DOCUMENTS 3,714,977 A * 2/1973 Terkelsen
3,810,504 A * 5/1974 Piwonka
4,108,236 A * 8/1978 Salkeld
4,757,856 A * 7/1988 George
4,763,716 A * 8/1988 Graham et al.
4,773,467 A * 9/1988 Graham et al.
4,774,992 A * 10/1988 George
4,969,501 A * 11/1990 Brokloff et al.
5,429,176 A * 7/1995 Atkinson et al.
5,778,961 A * 7/1998 Hugo et al.
6,276,432 B1 * 8/2001 Thompson et al.

* cited by examiner

*Primary Examiner*—Kuang Y. Lin
(74) *Attorney, Agent, or Firm*—Tarolli, Sundheim, Covell & Tummino L.L.P.

(57) ABSTRACT

As a mold containing molten metal is lowered from a heating chamber, a baffle extends around the mold. Force is transmitted from the mold to an inner section of the baffle to release connectors between the inner section of the baffle and an outer section of the baffle. As the connectors are released, a side surface on the inner section of the baffle moves out of the coplanar relationship with a side surface on the outer section of the baffle. The baffle may be integrally formed as one-piece. Rather than being formed as one-piece, the baffle may include separate pieces which form the inner and outer sections of the baffle. Alternatively, the inner section of the baffle may be disposed above and supported by the outer section of the baffle. Latches may be provided to interconnect the outer section of the baffle and the furnace assembly.

55 Claims, 4 Drawing Sheets

APPARATUS AND METHOD FOR CASTING A METAL ARTICLE

BACKGROUND OF THE INVENTION

The present invention relates to an apparatus and method which are used in the casting of a metal article. During withdrawal of a mold for the metal article from a heating chamber of a furnace, a baffle blocks transmission of heat from the heating chamber.

It has been previously been suggested to utilize a baffle to block transmission of heat from a heating chamber of a furnace during withdrawal of a mold from the heating chamber. The use of the baffle minimizes the loss of heat from the heating chamber so that the heating chamber remains at a relatively high temperature and the space below the heating chamber is maintained at a relatively low temperature. This temperature differential promotes solidification of molten metal from a lower end portion of the mold toward an upper end portion of the mold as the mold is withdrawn from the heating chamber.

It has previously been suggested that baffles may be utilized in association with molds to retard the transmission of heat from a heating chamber of a furnace. Various baffle constructions which have previously been suggested are disclosed in U.S. Pat. Nos. 4,108,236; 4,774,992; 4,969,501; and 6,276,432.

SUMMARY OF THE INVENTION

The present invention relates to a new and improved apparatus and method for use in casting a metal article. The apparatus may include a furnace assembly having a heating chamber. A chill plate may be provided to move a mold into and out of the heating chamber. A baffle may be utilized at a lower end portion of the heating chamber to at least partially block heat flow from the heating chamber during withdrawal of the mold from the heating chamber.

The baffle may have an inner section with an opening through which the mold extends when the mold is in the heating chamber. An outer section of the baffle may extend around the inner section of the baffle. A plurality of connectors may extend between the outer and inner sections of the baffle and hold them against movement relative to each other. The connectors may be releasable to enable the inner section of the baffle to move downward relative to an outer section of the baffle to increase the size of an opening through which the mold moves from the heating chamber.

The connectors may extend between the outer and inner sections of the baffle and retain one or more side surfaces on the outer and inner sections of the baffle in a coplanar relationship when the mold is in the heating chamber of the furnace assembly. The connectors may be releasable under the influence of force transmitted from the mold to enable the inner section of the baffle to move downward relative to the outer section of the baffle.

The baffle may be formed as one-piece with the connectors integrally formed as one-piece with the outer and inner sections of the baffle. The connectors may be broken under the influence of force transmitted from the mold to the baffle during lowering of the mold from the heating chamber. If desired, the outer and inner sections of the baffle may be separated by a plurality of slits with the connectors disposed between end portions of the slits and formed of the same material which forms the outer and inner sections of the baffle.

The outer and inner sections of the baffle may be formed as separate pieces. If this is done, the inner section of the baffle may initially be disposed in an opening in the outer section of the baffle and held in its initial position by a plurality of connectors which extend between the outer and inner sections of the baffle. The connectors are releasable to enable the inner section of the baffle to move downward out of the opening in the outer section of the baffle as the mold is moved from the heating chamber of the furnace assembly.

The inner section of the baffle may be disposed above and at least partially supported by the outer section of the baffle. If this is done, the inner section of the baffle may be moved downward through an opening in the outer section of a baffle to increase the size of an opening through which the mold is moved from the heating chamber.

Although the baffle may be connected with a furnace assembly in many different ways, it is believed that it may be desired to utilize latches to connect the baffle with the furnace assembly. The outer section of the baffle may be moved into engagement with and move the latches during movement of the baffle into the heating chamber in the furnace assembly. The latches are effective to retain the outer section of the baffle against downward movement relative to the furnace assembly during movement of the mold out of the heating chamber in the furnace assembly.

The present invention has a plurality of different features which may be used together or separately. One or more of the features of the present invention may be utilized in association with one or more features of the prior art.

SPECIFIC PREFERRED EMBODIMENTS OF THE INVENTION

General Description

Figure 1:
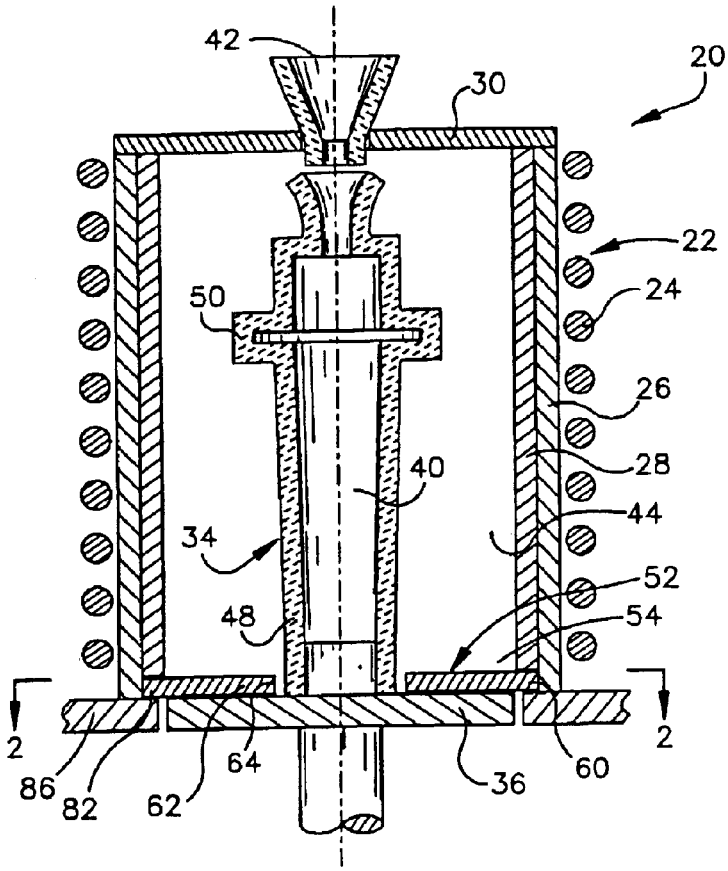
FIG. 1. is a schematic illustration depicting a relationship of a baffle to a furnace assembly having a heating chamber in which a mold is disposed.

An apparatus 20 (FIG. 1) is used to cast a blade or vane for a turbine engine. However, it should be understood that the apparatus 20 may be utilized to cast many different articles having many different configurations other than the specific configuration illustrated in FIG. 1. The apparatus 20 includes a furnace assembly 22.

The illustrated furnace assembly 22 is of the known induction type and includes a cylindrical induction coil 24. The induction coil 24 extends around a refractory wall 26 of the furnace assembly 22. A cylindrical radiation liner 28 is provided within the refractory wall 26. A circular cover 30 is provided at the upper end portion of the refractory wall 26.

The furnace assembly 22 may be enclosed by a housing. Once a mold 34 has been positioned in the housing on a circular chill plate 36, an inert atmosphere may be provided in the housing and the housing may be evacuated. The housing may have the same general construction as is disclosed in U.S. Pat. No. 3,841,384. If desired, a fluidized bed and/or housing may be utilized in the manner disclosed in U.S. patent application Ser. No. 09/569,906 filed May 11, 2000 by Graham et al and entitled System For Casting A Metal Article Using A Fluidized Bed. The disclosure from the aforementioned U.S. patent application Ser. No. 09/569, 906 is incorporated herein by reference.

When the mold 34 is to be utilized to cast a metal article, such as a turbine engine blade or vane, the cast metal article may be formed of a nickel-chrome super alloy. Of course, the cast article may be formed of a different metal if desired. The molten metal alloy may be solidified in a cavity 40 in the mold 34 with a crystallographic structure which is equiaxed, columnar grain, or single crystal. Although a mold 34 for casting a single article has been illustrated schematically in FIG. 1, it is contemplated that the mold 34 could be constructed so as to have two or more article mold cavities 40. For example the mold 34 may have the construction illustrated in U.S. Pat. Nos. 3,714,977; 4,763,716; or 4,969, 501. It is contemplated that the mold 34, may have any one of many different known constructions and have any desired number of mold cavities.

The molten metal is poured into the mold 34 through a funnel 42. Once the cavity 40 in the mold 34 has been filled with molten metal, the chill plate 36 is lowered to withdraw the mold from a cylindrical heating chamber 44 in the furnace assembly 22.

During pouring of the molten metal into the mold 34 and withdrawal of the mold from the furnace assembly, the heating chamber 44 may be maintained at a temperature of approximately 3,000 degrees Fahrenheit. Of course, the temperature in the heating chamber 44 may be different for different metals.

As the mold 34 is withdrawn from the heating chamber 44, the mold is exposed to a relatively cool environment disposed below the furnace assembly 22. The molten metal in the mold cavity 40 solidifies upward from a lower end portion 48 of the mold 34 toward an upper end portion 50 of the mold. A solidification front between liquid and solid metal moves upward relative to the mold 34 as the mold is withdrawn from the heating chamber 44. In order to promote upward solidification of molten metal in the mold cavity 40 a long a generally horizontal solidification front as the mold 34 is withdrawn from the heating chamber 40, it is advantageous to maintain a relatively large temperature gradiant between the heating chamber 44 and the environment disposed immediately beneath the furnace assembly 22.

When the mold 34 is constructed so as to have a plurality of mold cavities 40, the solidification fronts in each of the mold cavities will be at the same level as the mold is withdrawn from the furnace assembly 22. The solidification fronts in the plurality of mold cavities will move upward from lower end portions of the mold cavities toward the upper end portions of the mold cavities.

Regardless of how many mold cavities 40 are provided in the mold 34, a baffle 52 is provided at the lower end portion 54 of the heating chamber 44. The baffle 52 is effective to retard the transmission of heat between the heating, chamber 44 and the environment immediately beneath the furnace assembly 22. The baffle 52 (FIG. 2) has an annular outer section 60 which is connected with the furnace assembly 22 and a circular inner section 62. The inner section 62 has an opening 64 through which the mold 34 extends. It should be understood that the inner and outer sections of the baffle 52 could have a configuration other than circular.

The opening 64 advantageously has a configuration which corresponds to a cross sectional configuration of the lower end portion 48 of the mold 34. By forming the opening 64 with a configuration corresponding to the cross sectional configuration of the lower end portion of the mold 34, the amount of space between the inner section 62 of the baffle 52 and the exterior of the lower end portion 48 of the mold 34 is minimized. By minimizing the space between the exterior of the lower portion 48 of the mold 34 and the inner section 62 of the baffle 52, the baffle is effective to block radiation of heat from the heating chamber 44 during withdrawal of the lower portion of the mold 34 from the heating chamber.

When the mold 34 is constructed so as to have a plurality of article mold sections, in the manner disclosed in U.S. Pat. Nos. 3,714,977; 4,763,716; and 4,969,501, a plurality of openings 64 may be provided in the inner section 62 of the baffle 52. There may be a separate opening for each article mold section. Alternatively, a plurality of article mold sections could extend through a single opening 64 in the baffle 52.

The upper end portion 50 (FIG. 1) of the mold 34 has a substantially larger cross sectional configuration than the lower end portion 48 of the mold. Although the lower end portion 48 of the mold 34 can readily move through the opening 64, the upper end portion 50 of the mold is too large to move through the opening 64. Therefore, as the chill plate 36 and mold 34 are lowered relative to the furnace assembly 22, the upper end portion 50 of the mold moves into engagement with the inner section 62 of the baffle 52. The force applied against the inner section 62 of the baffle 52 is effective to release a plurality of connectors 70 (FIG. 2) which interconnect the outer section 60 and inner section 62 of the baffle 52.

Once the connectors 70 have been released, the inner section 62 of the baffle moves away from the outer section 60 of the baffle and increases the size of the opening in the baffle. The resulting, relatively large opening in the outer section 60 of the baffle can accommodate the upper end portion 50 of the mold 34. Therefore, during withdrawal of the upper end portion 50 of the mold 34 from the heating chamber 44, only the outer section 60 of the baffle 52 is effective to block the transmission of heat from the heating chamber 44. The inner section 62 of the baffle falls downward away from the furnace assembly onto the chill plate 36 which, at this time, is disposed in a substantial distance below the furnace assembly.

One-Piece Baffle

In accordance with one of a plurality of features of the present invention, the baffle 52 may be formed as one-piece. Portions of the outer section 60, inner section 62, and connectors 70 of the baffle 52 are all at least partially formed from a single piece of material.

As the mold 34 is withdrawn from the heating chamber 44, the upper end portion 50 of the mold applies force against the inner section 62 of the baffle 52. This force is effective to release the connectors 70.

The force applied against the inner section 62 of the baffle 52 is effective to break the connectors 70. This may result in the connectors 70 being broken with a tearing action or a snapping action. Once the connectors 70 have been broken to separate the inner section 62 from the outer section 60 of the baffle 52, the inner section of the baffle falls downward away from the outer section of the baffle. This results in the formation of a relatively large opening in the outer section 60 of the baffle. This opening will have a size and configuration corresponding to the size and configuration of the inner section 62 of the baffle 52.

Figure 2:
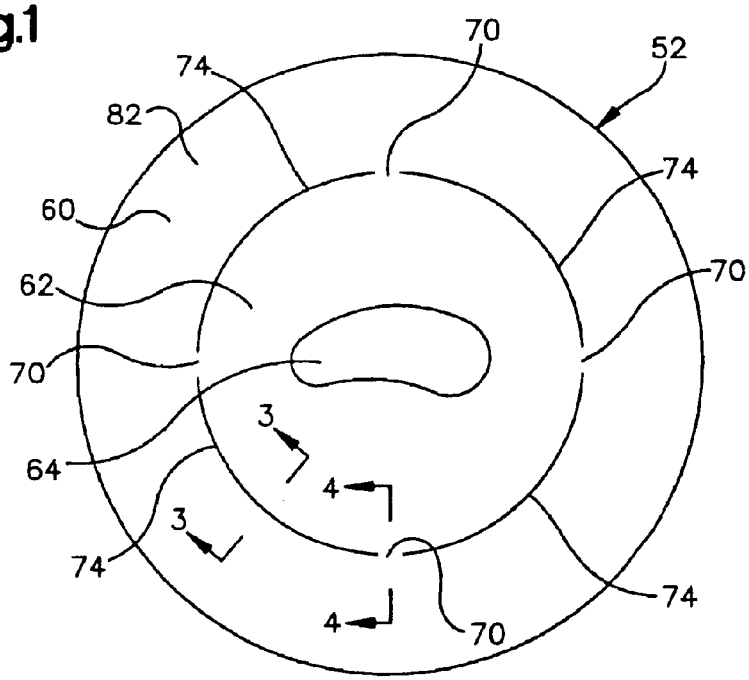
FIG. 2. is a schematic plan view, taken generally along the line 2—2 of FIG. 1, further illustrating the construction of the baffle.

In the embodiment of the baffle 52 illustrated in FIG. 2, the inner section 62 of the baffle 52 has a circular configuration and the outer section 60 of the baffle has an annular configuration. Therefore, when the connectors 70 are broken to release the inner section 62 of the baffle 52, a relatively large circular opening is provided in the baffle 52. The diameter of this relatively large opening is greater than the maximum transverse dimension of the upper end portion 50 of the mold 34. Therefore, the upper end portion 50 of the mold 34 can readily pass through the opening as the chill plate 36 continues to be lowered.

Although the periphery of the illustrated inner section 62 of the baffle 52 (FIG. 2) has been formed with a circular configuration, it is contemplated that the inner section 62 of the baffle could have a different peripheral configuration if desired. For example, the inner section 62 of the baffle 52 could have an outer edge with a configuration corresponding to the cross sectional configuration of the upper end portion 50 of the mold 34. The outer edge of the inner section 62 of the baffle 52 would be larger in size than the cross sectional size of the upper end portion 50 of the mold 34 to enable the mold to move through an opening formed by separation of the inner section from the outer section 60 of the baffle.

When the inner section 62 of the baffle 52 is separated from the outer section 60 of the baffle by releasing the connectors 70, the opening which is formed in the outer section 60 of the baffle will be larger than the cross sectional size of the upper end portion 50 of the mold 34. Therefore, the upper end portion of the mold 34 can be readily moved through the opening which results from separation of the inner section 62 of the baffle 52 from the outer section 60 of the baffle as the chill plate 36 continues to be lowered. The opening which is formed in the outer section 60 of the baffle 52 may have any desired configuration.

Figure 3:
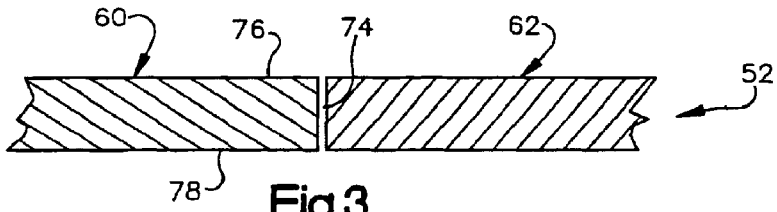
FIG. 3. is a schematic fragmentary sectional view, taken generally along the line 3—3 of FIG. 2, illustrating a slit which is formed in the baffle and separates an outer section of the baffle from an inner section of the baffle.

As initially formed, the inner section 62 of the one-piece baffle 52 may be separated from the outer section 60 of the baffle by a plurality of slits 74 (FIGS. 2 and 3). The slits 74 extend between upper and lower major side surfaces 76 and 78 of the baffle 52 (FIG. 3). The upper major side surface 76 extends parallel to the lower major side surface 78 of the baffle. Although the slits 74 extend perpendicular to the side surfaces 76 and 78 of the baffle 52, the slits may be skewed relative to the side surfaces of the baffle if desired.

Prior to releasing of the connectors 70 (FIGS. 2 and 4), the portion of the upper major side surface 76 of the baffle 52 disposed on the inner section 62 and connectors of the baffle is disposed in a coplanar relationship with the portion of the upper major side surface 76 disposed on the outer section 60 of the baffle. Similarly, the portion of the lower major side surface 78 disposed on the inner section 62 and connectors 70 of the baffle 52 is disposed in a coplanar relationship with the portion of the lower major side surface 78 disposed on the outer section 60 of the baffle.

The outer section 60, inner section 62 and connectors 70 of the one-piece baffle 52 are all at least partially formed from the same piece of material. The single piece of material from which the outer section 60, inner section 62, and connectors 70 are all at least partially formed has a circular configuration with a diameter corresponding to the diameter of a circular opening at the lower end portion 54 of the heating chamber 44 (FIG. 1) The single piece of material from which the baffle 52 is formed extends from the outer section 60, through the connectors 70, to the inner section 62. Of course, if the lower end portion of the heating chamber 44 had a different configuration, the single piece of material forming the baffle 52 would be cut to have a configuration which is different than the circular configuration illustrated in FIG. 2.

The outer section 60, inner section 62 and connectors 70 of the one-piece baffle 52 may all be formed from a single piece of material. Alternatively, the outer section 60, inner section 62 and/or connectors 70 may be formed of a plurality of pieces which are interconnected to form a baffle 52 having a one-piece construction. However, one of the plurality of pieces of the baffle 52 would form at least a portion of the outer section 60, inner section 62 and connectors 70.

The illustrated baffle 52 (FIGS. 2 and 4) is entirely formed by a single piece of material which completely forms the outer section 60, inner section 62 and connectors 70. Thus, the specific baffle 52, illustrated in FIGS. 2–4, consists of a single undivided piece of material. In the specific embodiment illustrated in FIG. 2, the single piece of material is a graphite felt. However, the material may be a ceramic or refractory metal if desired. Of course, the baffle 52 may be formed of other materials.

When the mold 34 is constructed so as to have two or more article mold cavities, in the manner previously mentioned, the inner section 62 of the baffle 52 may have a configuration which is different than the illustrated configuration. For example, the slits 74 may be arranged so as to partially define an opening through which the periphery of gating connected with a plurality of article molds can easily pass. This would enable the mold 34 to be constructed with a plurality of runners extending from a pour cup to each of a plurality of article mold cavities.

The baffle 52 may be provided with one or more radial slits to facilitate positioning the baffle relative to a relatively large base end portion of a mold, in a manner similar to that disclosed in U.S. Pat. No. 4,757,856. The slit or slits to facilitate positioning the baffle 52 relative to a relatively large base end portion of a mold would extend from a radially outer edge of the outer section 60 to the opening 64 in the inner section 62 of the baffle. The slit or slits to facilitate positioning of the baffle relative to a mold may extend through one or more of the connectors to or may be spaced from the connectors. The opening 64 may be configured to have two or more sections to receive end portions of two or more article mold sections of a mold.

Figure 4:
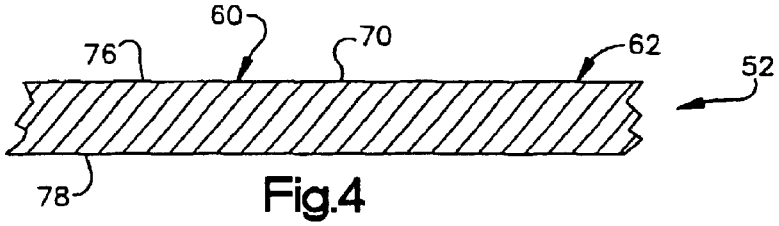
FIG. 4. is a fragmentary sectional view, taken generally along the line 4—4 of FIG. 2, schematically illustrating the construction of a connector which extends between the outer and inner sections of the baffle.

In the embodiment of the baffle 52 illustrated in FIG. 2, the slits 74 forming the inner section 62 are disposed in a circular array having a center which is coincident with the center of a circular outer rim portion 82 of the outer section 60 of the baffle 52. The connectors 70 are disposed between end portions of adjacent slits 74. The connectors 70 are formed with the same thickness and construction as the outer section 60 and inner section 62 of the baffle 52 (FIG. 4).

Until the connectors 70 are broken to release the inner section 62 of the baffle for movement relative to the outer section 60 of the baffle, there is a continuous uninterrupted body of material extending through the connectors 70 between the outer and inner sections of the baffle. If desired, the connectors 70 may be weakened by indenting or cutting partway through the material of the baffle 52 at the connectors. Regardless of whether or not the connectors 70 are preweakened to facilitate breaking of the connectors, the connectors 70 are formed by material which is one-piece with material forming the outer section 60 and inner section 62 of the baffle 52.

It is contemplated that the baffle 52 may be formed of many different materials. However, the baffle 52 is formed of a material which is capable of withstanding the relatively high temperatures to which it is exposed as a result of the high temperatures in the heating chambers 44. The baffle 52 may be formed of graphite, a suitable ceramic, or a suitable refractory metal. It is believed that it may be desired to form the baffle 52 as one-piece composed of one or more layers of graphite felt and/or graphite foil. The graphite felt may be enclosed by layers of graphite foil. Although the baffle 52 would have a multi layered construction, one of the layers of the baffle would form at least a portion of the outer section 60, inner section 62, and connectors 70.

In the embodiment of the invention illustrated schematically in FIG. 1, the outer rim portion 82 of the outer section 60 of the baffle 52 is clamped between a base member 86 which supports the furnace assembly 22 and the cylindrical radiation liner 28. However, the baffle 52 may be mounted in the furnace assembly 22 in any one of many known ways. For example, one or more releasable connectors may be utilized to mount the baffle 52 in the furnace assembly 22.

After the chill plate 36 has been moved to the raised position illustrated in FIG. 1, the cover 30 is removed from the furnace assembly 22 and the mold 34 is positioned in the heating chamber 44. The lower end portion 48 of the mold extends through the opening 64 in the inner section 62 of the baffle 52 and engages the chill plate 36. The cover 30 is then replaced. Alternatively, the baffle 52 and mold 34 may both be positioned on the chill plate 36 when the chill plate is in a fully lowered position. The baffle 52 may be positioned on the chill plate 36 with a central axis of the chill plate extending through the opening 64. The mold 34 may be positioned on the chill plate 36 with a lower end portion 48 of the mold extending through the opening 64 and with the mold and chill plate in a coaxial relationship.

If the mold 34 has a relatively large base plate on flange at a lower end portion 48 of the mold, the baffle 52 may be provided with a slit which extends from the opening 64 in the inner section 62 to a radially outer edge of the rim portion 82 of the outer section 60 of the baffle. This slit allows the baffle 52 to be flexed and positioned around the lower end portion 48 of the mold 34 at a location above the base plate or flange. This would result in the baffle 52 overlying the base plate or flange at the lower end portion of the mold 32 in a manner similar to that disclosed in U.S. Pat. Nos. 3,714,977 and 4,969,501.

Once the baffle 52 has been positioned on the chill plate 36, the chill plate is raised into the furnace assembly 22. The baffle 52 is connected with the furnace assembly 22 by a suitable retainer. The retainer may have a construction similar to the construction disclosed in U.S. Pat. No. 4,774,992 or other known construction. Alternatively, latches similar to the latches illustrated in FIGS. 12–14 herein may be used to connect the baffle 52 with the furnace assembly 22.

If desired, the baffle 52 may be divided into a plurality of segments in a manner similar to the disclosure in U.S. Pat. No. 4,969,501. If this is done, the segments of the baffle may be interconnected after they have been positioned relative to the mold 34. Dividing the baffle 52 into segments would facilitate placement of the baffle relative to a complicated mold structure. However, dividing the baffle 52 into segments would complicate construction of the baffle, would increase the time required to position the baffle, and would weaken the baffle. Therefore, unless required by a complicated mold structure, it is believed that it will be preferred to avoid dividing baffle 52 into segments and reconnecting the segments.

After the mold 34 has been preheated to a desired temperature by operation of the furnace assembly 22, molten metal is poured through the funnel 42 into the mold cavity 62. After the mold cavity 40 has been filled with molten metal, the chill plate 36 is slowly lowered to withdraw the mold 34 from the heating chamber 44. As this occurs, the molten metal solidifies with a solidification front which is disposed adjacent to the baffle 52. Therefore, as the mold 34 is lowered, the solidification front moves upward in the mold cavity 40 toward the upper end portion 50 of the mold. As this occurs, the solidification front remains adjacent to the baffle 52.

As the mold 34 continues to be lowered from the heating chamber 44, the relatively large upper end portion 50 of the mold 34 moves into engagement with the portion of the upper major side surface 76 of the baffle 52 disposed adjacent to the opening 64 through the inner section 62 of the baffle. As the chill plate 36 continues to be lowered, force is applied against the upper side of the inner section 62 of the baffle 52 by the upper portion 50 of the mold. This force is transmitted to the connectors 70. The force transmitted from the mold 34 to the connectors 70 is effective to release the connectors.

Depending upon the characteristics of the material from which the baffle 52 is formed, the connectors 70 may release with a tearing action or with a snapping action. Thus, if the baffle 52 is formed of a flexible graphite felt, the connectors 70 may be broken with a tearing action. Alternatively, if the one-piece baffle 52 is formed of a relatively brittle material, such as a ceramic or a refractory metal, the connectors 70 may be brittle and break with a snapping action.

Figure 5:
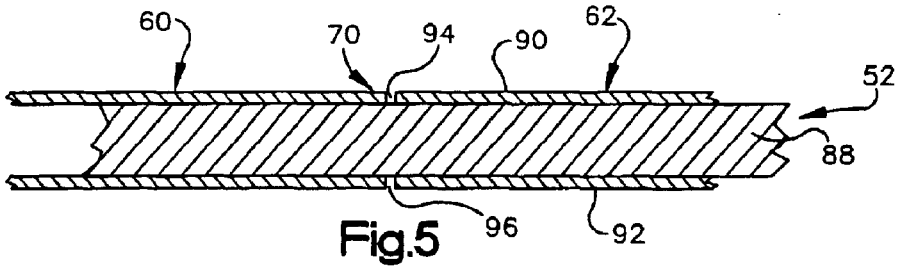
FIG. 5. is a fragmentary schematic illustration, generally similar to FIG. 4, depicting an alternative construction of the connector which interconnects the inner and outer sections of the baffle.

The one-piece baffle 52 may be formed with a layered construction illustrated in FIG. 5. If the baffle 52 is formed with a layered construction, the baffle may have a graphite felt inner layer 88. A graphite foil upper layer 90 may be positioned on and connected to the inner layer 88. Similarly, a graphite foil lower layer 92 may be positioned on and connected to the inner layer 88. In the embodiment illustrated in FIG. 5, the upper and lower, layers 90 and 92 are cut at 94 and 96 to weaken the connectors 70 at locations disposed between the outer and inner sections of the one-piece baffle 52. The inner layer 88 forms at least a portion of the outer section 60, inner section 62, and connectors 70. In the embodiment illustrated in FIG. 5, the inner layer 88 is coextensive with the outer section 60, inner section 62, and connectors 70.

Once the connectors 70 have been broken, the inner section 62 of the baffle 52 falls downward onto the chill plate 62. As this occurs, a relatively large opening is formed in the outer section 60 of the baffle. The opening formed in the outer section 60 of the baffle 52 is large enough to enable the upper end portion 50 of the mold to freely move downward through the baffle as the chill plate 36 continues to be lowered.

In the embodiment of the invention illustrated in FIG. 2, a circular opening is formed in the center of the outer section 60 of the baffle 52 when the connectors 70 are broken to release the inner section 62. However, it is contemplated that the slits 74 could have a configuration other than the arcuate configuration illustrated in FIG. 2 so that the opening formed in the outer section 60 of the baffle 52 would have a configuration which is different than a circular configuration. For example, the opening formed in the outer section 60 of the baffle may have a configuration similar to and slightly larger than the cross sectional configuration of the upper end portion 50 of the mold 34.

Baffle With Separate Sections and Connectors

Figure 6:
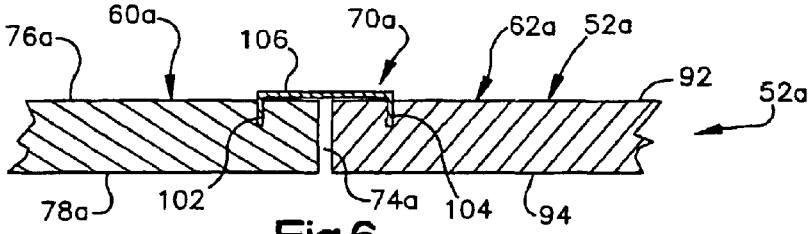
FIG. 6. is a fragmentary schematic illustration, generally similar to FIGS. 4 and 5, illustrating a baffle having an inner section which is separate from an outer section and the manner in which a connector retains the inner section of the baffle in an opening in the outer section of the baffle.

In the embodiments of the invention illustrated in FIGS. 1–5, the outer section 60, inner section 62 and connectors 70 of the baffle 52 are all at least partially formed from one-piece of material, for example, the inner layer 88 of FIG. 5. In the embodiment of the invention illustrated in FIGS. 6–8, the outer section, inner section, and connectors for the baffle are formed by separate pieces. Since the embodiment of the invention illustrated in FIG. 6 are generally similar to the embodiments of the invention illustrated in FIGS. 1–5, similar numerals have been utilized to designate similar components, the suffix letter "a" being added to the numerals of FIG. 6 to avoid confusion.

A baffle 52*a* is utilized in association with a furnace assembly 22 (FIG. 1) in the same manner as is the baffle 52. The baffle 52*a* (FIG. 6) includes an annular outer section 60*a* and a circular inner section 62*a*. The circular inner section 62*a* is separate from the annular outer section 60*a*. An opening, corresponding to the opening 64 of FIG. 1, is provided in the inner section 60*a*.

A circular slit 74*a* separates the outer section 60*a* from the inner section 62*a* The slit 74*a* forms a circular opening in the outer section 60*a*. The inner section 62*a* is disposed in the opening in the outer section 60*a*. If desired, the inner section 62*a* and the slit 74*a* may be formed with a configuration which is a different than a circular configuration. If this was done, the opening in the outer section 60*a* would have a non-circular configuration.

A plurality of connectors 70*a* extend between the outer section 60*a* and the inner section 62*a* and hold the outer and inner sections against movement relative to each other. An upper major side surface 76*a* of the outer section 60*a* is disposed in a coplanar relationship with an upper major side surface 92 on the inner section 62*a*. Similarly, a lower major side surface 78*a* on the outer section 60*a* on the baffle 52*a* is disposed in a coplanar relationship with a lower major side surface 94 on the inner section 62*a*.

The connector 70*a* interconnects the outer section 60*a* and inner section 62*a* to maintain the upper major side surfaces 76*a* and 92 of the baffle 52*a* in one plane which extends parallel to a plane in which the lower major side surfaces 78*a* and 94 of the baffle are disposed. The connector 70*a* is formed separately from the outer section 60*a* and inner section 62*a* of the baffle 52*a*. The connector 70*a* is secured to and extends between the outer section 60*a* and inner section 62*a*. The connector 70*a* is formed of a material which is different than the material which forms the outer section 60*a* and inner section 62*a*. However, the outer section 60*a*, inner section 62*a*, and connector 70*a* may be formed of the same material.

The annular outer section 60*a* of the baffle 52*a* extends around the inner section 62*a* of the baffle. Thus, the circular inner section 62*a* is disposed in a circular opening formed in the outer section 60*a*. The outer section 60*a* of the baffle 52*a* may be connected with the furnace assembly 22 in the same manner as illustrated in FIG. 1. A plurality of connectors 70*a* transmit force between the outer section 60*a* and inner section 62*a* of the baffle 52*a* to maintain the baffle in the opening in the outer section during withdrawal of the lower portion of the mold from the heating chamber of the furnace assembly.

In the embodiment illustrated in FIG. 6, the connector 70*a* is formed separately from the outer section 60*a* and inner section 62*a*. The illustrated connect or 70*a* is a connector member or staple having a leg or end portion 102 which engages the outer section 60*a* of the baffle 52*a*. The connector 70*a* has a leg or end portion 104 which engages the inner section 62*a* of the baffle 52*a*. An intermediate portion 106 extends between the two end portions 102 and 104 and spans the slit 74*a*.

In the embodiment of the connector 70*a* illustrated in FIG. 6, the two end portions 102 and 104 have longitudinal central axes which extend transverse to a longitudinal central axis of the intermediate portion 106. Although the end portions 102 and 104 extend perpendicular to the intermediate portion 106 in the illustrated embodiment of the connector 70*a*, it is contemplated that the end portions 102 and 104 could be skewed relative to the intermediate portion 106 and extend toward each other. This would result in the connectors 70*a* being effective to interconnect the outer section 60*a* and the inner section 62*a* of the baffle 52*a* with a clinching action.

The connector 70*a* may be formed of any desired material. For example, the connector 70*a* may be formed of a ceramic material. Alternatively, the connector 70*a* may be formed of a metal capable of withstanding the high temperatures to which it is exposed. Although the intermediate portion 106 of the connector 70*a* has been illustrated in FIG. 6 as extending along the upper major side surfaces 76*a* and 92 of the baffle 52*a*, it is contemplated that the connector 70*a* could be disposed on the lower side of the baffle.

Positioning the connector 70*a* on the lower side of the baffle 52*a* would result in the connector being disposed adjacent to the chill plate 36 (FIG. 1). By positioning the connector adjacent to the chill plate 36, the temperature to which the connector 70*a* is exposed tends to be minimized. If desired, the end portions 102 and 104 could be eliminated from the connector 70*a* and the connector located between the upper major side surfaces 76*a* and 92 and the lower major side surfaces 78*a* and 94 of the baffle 52*a*. If this was done, it may be desired to increase the length of the intermediate portion 106 from the relatively short length illustrated in FIG. 6.

Regardless of whether the connector 70*a* is disposed adjacent to the upper side of the baffle 52*a* (as illustrated in FIG. 6), adjacent to the lower side of the baffle, or disposed between upper and lower sides of the baffle, the connector spans the slit 74*a* which separates the outer section 60*a* from the inner section 62*a* of the baffle. By spanning the joint between the outer section 60*a* and inner section 62*a* of the baffle 52*a*, the connector 70*a* is effective to transmit force from the outer section 60*a* of the baffle to the inner section 62*a* of the baffle to hold the inner section of the baffle in the opening in the outer section of the baffle during withdrawal of the lower portion of the mold 34 (FIG. 1) from the heating chamber 44.

The outer section 60*a* consists of a single layer of graphite felt. Similarly, the inner section 62*a* consists of a single layer of graphite felt. However, the outer and inner sections 60*a* and 62*a* may have a different construction if desired. For example, the outer and inner sections 60*a* and 62*a* may have the multilayered construction previously described in conjunction with FIG. 5.

When a metal article is to be cast in the mold 34, the baffle 52*a* is mounted in the lower end portion of the heating chamber 44 in the manner previously described in connection with the embodiment of the invention illustrated in FIGS. 1–5. The chill plate 36 is moved upward to a position adjacent to the lower side of the baffle 52*a*. The cover 30 (FIG. 1) is then removed and the mold 34 positioned on the chill plate. Of course, the mold 34 may be positioned on the chill plate 36 and raised toward the furnace assembly with the chill plate.

Once molten metal has been poured into the mold 34, the chill plate 36 is slowly lowered. Lowering the chill plate 36 results in the mold 34 being slowly withdrawn from the heating chamber 44. As the mold 34 is withdrawn from the heating chamber 44, the molten metal in the mold solidifies at a solidification front which is maintained adjacent to the baffle 52. This results in the solidification front being displaced upward in the mold cavity 40 as the mold is withdrawn from the heating chamber 44.

Upon completion of withdrawal of the lower portion 48 of the mold 34 from the heating chamber 44, the upper end portion 50 of the mold moves into engagement with the upper major side surface 92 (FIG. 6) of the inner section 62*a* of the baffle 52*a*. The force applied against the upper major side surface 92 of the inner section 62*a* of the baffle 52*a* is effective to release the connectors 70*a*. The inner section 62*a* of the baffle 52*a* then drops downward onto the chill plate 36. This results in the formation of a relatively large opening in the stationary outer section 60*a* of the baffle 52*a*. As the chill plate 36 continues to be lowered, the upper end portion 50 of the mold 34 moves through the relatively large opening created by separating the inner section 62*a* of the baffle 52*a* from the outer section 60*a* of the baffle.

As the upper end portion 50 of the mold 34 moves into initial engagement with the inner section 62*a* of the baffle 52*a*, the mold applies a downward force against the upper major side surface 92 of the inner section 62*a*. This force is effective to move the inner section 62*a* downward relative to the stationary outer section 60*a* of the baffle 52*a*. As this occurs, the inner section 62*a* of the baffle slides along the end portion 104 of the connector 70*a*. As the inner section 62*a* continues to move downward and out of the circular opening formed in the outer section 60*a* of the baffle 52*a*, the end portion 104 of the connector 70*a* and the inner section 62*a* of the baffle are separated to release the baffle for downward movement onto the chill plate under the influence of gravity.

Although the specific connector 70*a*, illustrated in FIG. 6, is released by being disengaged from the inner section 62*a*, the connector could be released in a different manner if desired. For example, the connector 70*a* could be deformed and/or torn from the outer section 60*a* or inner section 62*a*. The connector 70*a* may be constructed so as to break at the intermediate portion 106 of the connector to release the inner section 62*a* of the baffle 52*a*.

Although only a single connector 70*a* has been illustrated schematically in FIG. 6, it should be understood that there are a plurality of identical connectors 70*a*. The plurality of connectors 70*a* span the slit 74*a* tat spaced apart locations along the slit. The number of connector members 70*a* utilized to interconnect the outer section 60*a* and inner section 62*a* of the baffle 52*a* will be a function of the weight of the inner section 62*a* of the baffle. Thus, the greater the weight of the inner section 62*a* of a baffle, the greater the number of connectors 70*a* which will be utilized. For example, four connectors 70*a* may be positioned at spaced apart locations between the outer section 60*a* and inner section 62*a* of the baffle 52*a* in much the same manner as in which four connectors 70 are positioned in FIG. 2. However, a greater or lesser number of connectors 70*a* may be utilized if desired.

In the embodiment of the invention illustrated in FIG. 6, a connector member extends along outer surfaces of the baffle 52*a*. Thus, the connector member 70*a* extends along the upper major side surfaces 76*a* and 92 of the baffle. However, the connector member 70*a* may extend along the lower major side surfaces 78*a* and 94 of the baffle.

Figure 7:
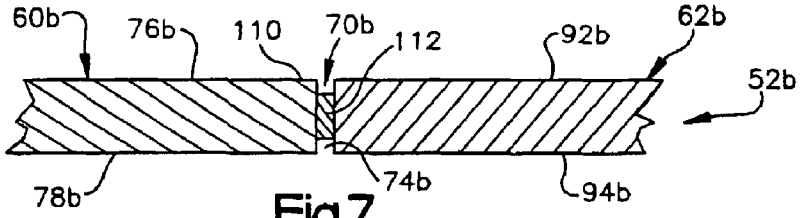
FIG. 7. is a fragmentary schematic sectional view, generally similar to FIGS. 4–6, illustrating the manner in which adhesive may be utilized to retain a inner section of the baffle in an opening in an outer section of the baffle.

In the embodiment of the invention illustrated in FIG. 7, a connector is positioned in a joint between outer and inner sections of the baffle. Since the embodiment of the invention illustrated in FIG. 7 is generally similar to the embodiments of the invention illustrated in FIGS. 1–6, similar numerals will be utilized to identify to similar components, the suffix letter "b" being associated with the numerals of FIG. 7 to avoid confusion.

A baffle 52*b* has an outer section 60*b* which is connected with an inner section 62*b* by a connector 70*b*. In the embodiment of the invention illustrated in FIG. 7, the connector 70*b* is located in a circular slit 74*b* between the annular outer section 60*b* and circular inner section 62*b* of the baffle. The connector 70*b* is disposed in the slit 74*b* between a plane containing an upper major side surface 76*b* of the outer section 60*b* and an upper major side surface 92*b* of the inner section 62*b* of the baffle and a plane containing a lower major side surface 78*b* on the outer section 60*b* and a lower major side surface 94*b* on the inner section 62*b* of the baffle 52*b*. Although the connector 70*b* is disposed entirely within the slit 74*b*, it is contemplated that a portion of the connector 70*b* could extend upward and/or downward from the slit.

The connector 70*b* transmits force between the outer section 60*b* and inner section 62*b* of the baffle 52*b* to support the inner section 62*b* of the baffle. The circular inner section 62*b* of the baffle is disposed in a circular opening formed in the annular outer section 60*b* of the baffle. The upper major side surfaces 76*b* and 92*b* of the baffle are disposed in a coplanar relationship., Similarly, the lower major side surfaces 78*b* and 94*b* of the baffle are disposed in a coplanar relationship. An opening, corresponding to the opening 64 of FIG. 2, is provided in the inner section 62*b* of the baffle 52.

The connector 70*b* is formed by one or more bodies of adhesive. The adhesive of the connector 70*b* is connected to an annular inner rim portion 110 of the outer section 60*b* of the baffle 52*b*. The adhesive of the connector 70*b* is also connected to an annular outer rim portion 112 of the inner section 62*b* of the baffle 52*b*. This enables force to be transmitted through the adhesive forming the connector 70*b* to hold the inner section 62*b* of the baffle in an opening formed in the outer section 60*b* of the baffle 52*b*.

The connector 70*b* may be formed by a plurality of relatively small bodies or dots of adhesive which are disposed in the slit 74*b* between the outer section 60*b* and inner section 62*b* of the baffle 52*b*. Alternatively, the connector 70*b* may be formed by an annular ring of adhesive which is coextensive with the slit 74*b*. Of course, a plurality of spaced apart elongated bodies of adhesive may be provided rather than small dots or a single body of adhesive.

The outer section 60*b* consists of a single layer of graphite felt. Similarly, the inner section 62*b* consists of a single layer of graphite felt. However, the outer and inner sections 60*b* and 62*b* may have different construction if desired. For example, the outer and inner sections 60*b* and 62*b* may have the multilayered construction previously described in conjunction with FIG. 5.

Figure 11:
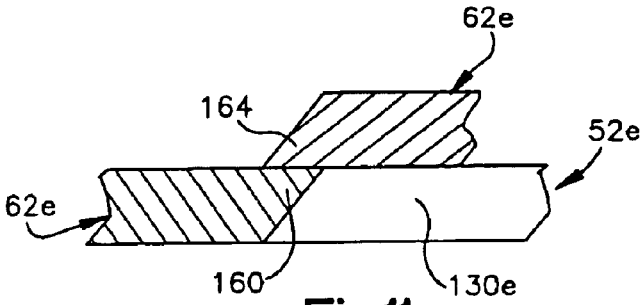
FIG. 11. is a enlarged schematic illustration depicting the manner in which an outer rim portion of the inner section of the baffle of FIG. 10 is supported by an inner rim portion of the outer section of the baffle.

When the baffle 52*b* is mounted on the lower end portion of the furnace assembly 22, in the same manner as is illustrated schematically for the baffle 52 in FIG. 11, force is transmitted through the adhesive of the connector 70*b* to hold the inner section 62*b* in the circular opening formed in the outer section 60*b* of the baffle. As the mold 34 is withdrawn from the heating chamber 44 (FIG. 1), the upper end portion 50 of the mold moves into engagement with inner section 62*b* of the baffle 52*b* and applies force against the inner section of the baffle.

The force applied by the upper end portion 50 of the mold 34 against the inner section 62*b* of the baffle 52*b* is effective to release the connector 70*b*. This may be done tearing the material of the baffle 52*b* adjacent to the adhesive forming the connector 70*b* or by breaking the adhesive material itself. Once the connector 70*b* has been released, the inner section 62*b* of the baffle 52*b* is free to fall downward onto the chill plate 36. The upper end portion 50 of the mold 34 can then be moved through the relatively large opening formed by disconnecting the inner section 62*b* of the baffle from the outer section 60*b* of the baffle.

Figure 8:
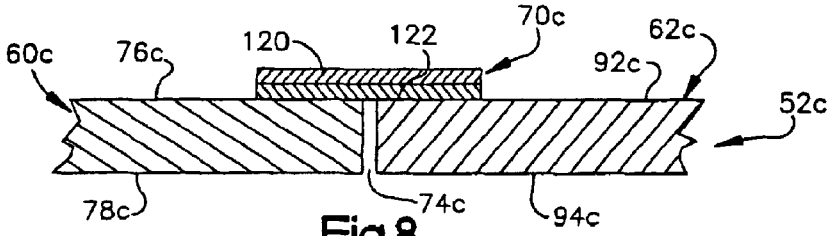
FIG. 8. is a schematic sectional view, generally similar to FIGS. 4–7, illustrating the manner in which a connector member and adhesive may be utilized to hold the inner section of the baffle in an opening in the outer section of the baffle.

In the embodiment of the invention illustrated in FIG. 6, the connector 70*a* is formed by a member which extends between the outer and inner sections 60*a* and 62*a* of the baffle 52*a*. In the embodiment of the invention illustrated in FIG. 7, the connector is formed by adhesive which extends between the outer section 60*b* and inner section 62*b* of the baffle 52*b*. In the embodiment of the invention illustrated in FIG. 8, the connector is formed by both a member and a body of adhesive which extend between the outer section and the inner section of the baffle. Since the embodiment of the invention listed in FIG. 8 is generally similar to the embodiments of the invention illustrated in FIGS. 1–7, similar numerals will be utilized to designate similar components, the suffix letter "c" being associated with the numerals of FIG. 8 to avoid confusion.

A baffle 52*c* (FIG. 8) includes an annular outer section 60*c* and a circular inner section 62*c*. An opening corresponding to the opening 64 of FIG. 1, is formed in the inner section 62*c* (FIG. 8). The outer and inner sections 60*c* and 62*c* are separated by circular slit 74*c*.

A connector 70*c* spans to slit 74*c*. The connector 70*c* is effective to hold the inner section 62*c* in a circular opening formed in the outer section 60*c* of the baffle. An upper major side surface 76*c* on the outer section 60*c* of the baffle 52*c* is disposed in a coplanar relationship with an upper major surface 92*c* on the inner section 62*c* of the baffle. Similarly, a lower major side surface 78*c* on the outer section 60*c* of the baffle 52*c* is disposed n a coplanar relationship with a lower major side surface 94*c* on the inner section 62*c* of the baffle.

The connector 70*c* is formed by a connector member 120 which spans the slit 74*c* and a body 122 of adhesive. The body 122 of adhesive connects the connector member 120 to the outer section 60*c* and inner section 62*c* of the baffle 52*c*.

The connector member 120 may be flexible and formed of a material which can withstand relatively high temperatures, such as a graphite cloth. The connector member 120 may be tape. Alternatively, the connector member 120 may be formed of a rigid material, such as a ceramic or refractory material. Regardless of whether the connector member 120 is flexible or rigid, it is connected with both the outer section 60*c* and the inner section 62*c* of the baffle 52*c* by the body 122 of adhesive.

The body 122 of adhesive may have a configuration corresponding to a configuration of the connector member 120. Thus, the connector member 120 may be formed by an elongated strip or rod and the body 122 may be an elongated strip of adhesive. Although only one connector member 120 and body 122 of adhesive are illustrated in FIG. 8, it should be understood that there are a plurality of connector members and bodies of adhesive arranged in a circular array along the slit 74*c*.

Alternatively, the connector member 120 may have an annular configuration and be coextensive the slit 74*c*. If this is done, the body 122 of adhesive would have an annular configuration and be coextensive with the slit 74*c*.

The connector member 120 and body 122 of adhesive are illustrated in FIG. 8 as being disposed adjacent to the upper side surfaces 76*c* and 92*c* of the outer and inner sections 60*c* and 62*c* of the baffle 52*c*. However, the connector member 120 and body 122 of adhesive may be disposed adjacent to the lower side surfaces 78*c* and 94*c* of the outer and inner sections 60*c* and 62*c* of the baffle 52*c*. This would result in the connector 70*c* being exposed to the relatively cool chill plate 36.

The outer section 60*c* consists of a single layer of graphite felt. Similarly, the inner section 62*c* consists of a single layer of graphite felt. However, the outer and inner sections 60*c* and 62*c* may have a different construction if desired. For example, the outer and inner sections 60*c* and 62*c* may have the multilayered construction previously described in conjunction with FIG. 5.

Connector Rods

Figure 9:
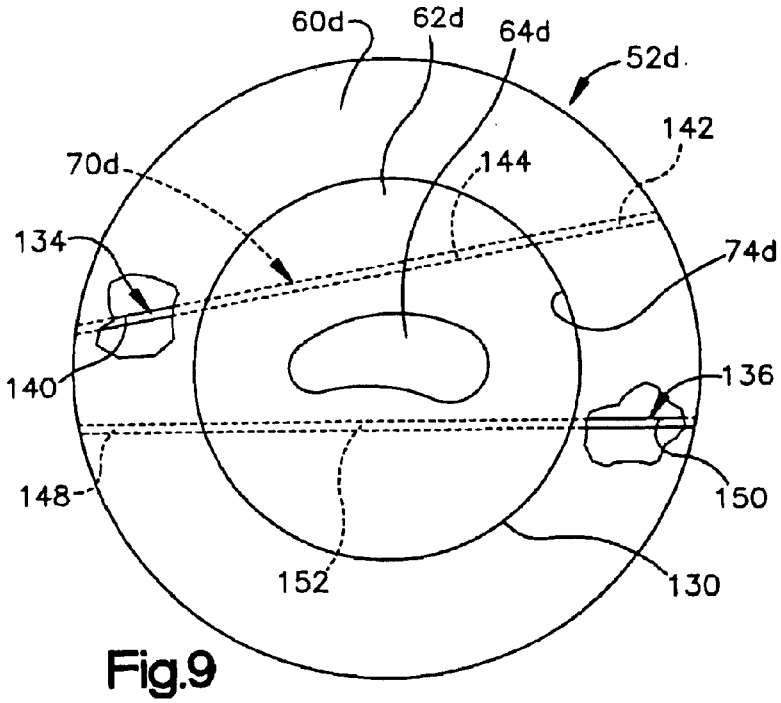
FIG. 9. is a schematic plan view, generally similar to FIG. 2, illustrating the manner in which breakable members may be utilized to hold an inner section of a baffle in an opening in an outer section of the baffle.

In the embodiments of the invention illustrated in FIGS. 6–8, the connectors 70*a*, 70*b*, and 70*c* extend between the outer sections and inner sections of the baffles. In the embodiment of the invention illustrated in FIG. 9, the connectors extend from one portion of the outer section of the baffle, along the inner section of the baffle, to another portion of the outer section of the baffle. Since the embodiment of the invention illustrated in FIG. 9 is generally similar to the embodiments of the invention illustrated in FIGS. 1–8, similar numerals will be utilized to designate similar components, the suffix letter "d" being associated with the numerals of FIG. 9 to avoid confusion.

A baffle 52*d* has an annular outer section 60*d* and a circular inner section 62*d*. The outer section 60*d* and inner section 62*d* are separated by a circular slit 74*d*. A connector 70*d* supports the circular inner section 62*d* in a circular opening 130 formed in the annular outer section 60*d*.

When the inner section 62*d* is disposed in the opening 130 in the outer section 60*d*, an upper side surface of the outer section 60*d* is disposed in a coplanar relationship with an upper side surface of the inner section 62*d*. Similarly, a lower side surface of the outer section 60*d* is disposed in a coplanar relationship with an outer side surface of an inner section 62*d* in the manner previously explained in conjunction with the embodiments of the invention illustrated in FIGS. 6–8. In the embodiments of the invention illustrated in FIGS. 6–9 both upper side surfaces of the inner and outer sections of the baffle and lower side surfaces of the inner and outer sections of the baffle are disposed in a coplanar relationship. However, it is contemplated that only the upper side surfaces of the inner and outer sections of the baffle may be disposed in a coplanar relationship. Alternatively, only the lower side surfaces of the inner and outer sections of the baffle may be disposed in a coplanar relationship.

The connector 70*d* includes a plurality of elongated members or rods 134 and 136. The rods 134 and 136 extend in a chordal manner across the circular opening 130 in the outer section 60*d* and are spaced from an opening 64*d* in the inner section 62*d*. Thus, the left (as viewed in FIG. 9) end portion 140 of the connector member or rod 134 is disposed in engagement with one portion of the outer section 60*d*. A right (as viewed in FIG. 9) end portion 142 of the connector member 134 is disposed in engagement with another portion of the outer section 60*d*. An intermediate portion 144 of the connector member or rod 134 is disposed in engagement with the inner section 62*d* and forms a chord to the circular opening 130. The intermediate portion 144 of the connector member or rod 134 is spaced from the opening 64*d* in the inner section 62*d*.

Similarly, the connector member or rod 136 includes a left (as viewed in FIG. 9) end portion 148 which is disposed in engagement with a portion of the outer section 60*d* of the baffle 52*d*. A right (as viewed in FIG. 9) end portion 150 of the connector member or rod 136 is disposed in engagement with another portion of the outer section 60*d*. An intermediate portion 152 of the rod extends across the opening 130 in the outer section 60*d* in a chordal manner. The connector member or rod 136 is spaced from the opening 64*d*. Since the connector members or rods 134 and 136 are spaced from the opening 64*d* in the inner section 62*d*, the mold 34*d* can be positioned in the opening 64*d* without interference with the connector members or rods.

In the embodiment of the invention illustrated in FIG. 9, the connector members or rods 134 and 136 are disposed in engagement with lower side surfaces of the outer section 60*d* and inner section 62*d*. The connector members or rods 134 and 136 support the outer section 60*d* and inner section 62*d* with their lower side surfaces in a coplanar relationship. The outer section 60*d* and inner section 62*d* have the same thickness. Therefore, the upper side surfaces of the outer section 60*d* and inner section 62*d* are disposed in a coplanar relationship. The connector members or rods 134 and 136 have longitudinal central axes which extend parallel to the upper and lower major side surfaces of the outer section 60*d* and inner section 62*d* of the baffle 52*d*.

The left and right end portions 140 and 142 of the connector member or rod 134 rest on the base member 86 (FIG. 1) at a location beneath the outer section 60*d*. Similarly, the left and right end portions 148 and 150 of the connector member or rod 136 rest on the base member 86 at locations beneath the outer section 60*d*. The connector members or rods 134 and 136 span the circular opening 130. This enables the connector members or rods 134 and 136 to support the inner section 62*d* of the baffle 52*d* in the circular opening 130.

The end portions 140, 142, 148 and 150 of the connector members or rods 134 and 136 rest on a flat upper surface of the base member 86 (FIG. 1). However, it is contemplated that it may be desired to provide notches in the base member 86 to locate the connector members or rods 134 and 136 relative to the base member.

When the baffle 52*d* is to be installed in the furnace assembly 22 (FIG. 1) the connector members or rods 134 and 136 are positioned on the base member 86. To facilitate positioning of the connector members or rods 134 and 136, the base member 86 may include a removable ring on which the rods rest. Alternatively, the cover 30 and radiation liner 28*b* may be removed from the furnace assembly 22 and the connector members or rods 134 and 136 positioned on the base 86.

Once the connector members or rods 134 and 136 have been positioned on the base member 86, the outer section 60*d* of the baffle 52*d* is positioned on the connector members or rods 134 and 136. The inner section 62*d* is then positioned on the intermediate portions 144 and 152 of the connector members or rods 134 and 136. This enables the connector members or rods 134 and 136 to support the inner section 62*d* in the circular opening 130. The radiation liner 28 may then be replaced in the furnace assembly 22. Once the mold 34 has been positioned on the chill plate 36 with the lower end portion 48 of the mold extending through the opening 64*d* in the baffle 52*d*, the cover 30 can be placed on the furnace assembly 22.

After the heating chamber 44 and mold 34 have been heated to a desired temperature, molten metal is poured through the funnel 32 into the mold 34. The chill plate 36 is then lowered to initiate withdrawal of the mold 34 from the furnace assembly 22.

As the chill plate 36 is lowered and the mold 34 is withdrawn from the furnace assembly 22, the upper end portion 50 of the mold moves into engagement with the inner section 62*d* adjacent to the periphery of the opening 64*d* and the connector members or rods 134 and 136. The force applied against the inner section 62*d* of the baffle 52*d* by the upper end portion 50 of the mold 34 is effective to break the connector members or rods 134 and 136 with a snapping action. Breaking the connector members or rods 134 and 136 releases the inner section 62*d* for movement out of the circular opening 130 in the outer section 60*d*. As this occurs, the inner section 62*d* of the baffle 52 falls downward onto the chill plate. The upper end portion 50 of the mold 34 can then move through the relatively large circular opening 130 in the stationary outer section 60*d* as the mold 34 continues to withdrawn from the furnace assembly.

The connector members or rods 134 and 136 are formed of a ceramic material such as quartz. However, the connector members or rods 134 and 136 could be formed of a different material if desired.

In the embodiment of the invention illustrated in FIG. 9, the connector members or rods 134 and 136 are separate from the outer section 60*d* and inner section 62*d* of the baffle 52*d*. However, if desired, the connector members or rods 134 and 136 could be connected with the lower side of the baffle 52*d*. The connector members or rods 134 and 136 may be connected with the lower side of the baffle 52*d* by a suitable adhesive or by mechanical fasteners.

Although the connector members or rods 134 and 136 are disposed beneath the baffle, the connector members or rods could be disposed above the baffle. If this was done, the connector members or rods 134 and 136 would be connected with the upper side of the inner section 62*d* of the baffle 52*d* by a suitable adhesive or mechanical fasteners.

If desired, the connector members or rods 134 and 136 may be embedded in the material forming the outer section 60*d* and inner section 62*d* of the baffle 52*d*. This would result in the connector members or rods 134 and 136 being enclosed by the material of the baffle.

Rather than having the connector members or rods 134 and 136 extend between spaced apart locations on the outer section 60*d* of the baffle 52*d*, the connector members or rods 134 and 136 could be shorter and extend only from the outer section 60*d* to the inner section 62*d* of the baffle 52*d*. Thus, a circular array of three or more relatively short connector members or rods may extend radially inward from the outer section 60*d* to the inner section 52*d* without spanning the opening 130. If this was done, the relatively short connector members or rods may be attached to the lower sides of the outer section 60*d* and inner section 62*d*. Alternatively, the relatively short connector members or rods may be embedded in the material of the outer section 60*d* and inner section 62*d*.

The outer section 60*d* of the baffle 52*d* consists of a single layer of graphite felt. Similarly, the inner section 62*d* consists of a single layer of graphite felt. However, the outer and inner sections 60*d* and 62*d* of the baffle 52*d* may have a different construction. For example, the outer and inner sections 60*d* and 62*d* may have the multilayered construction previously described in conjunction with FIG. 5.

Baffle With Raised Inner Section

In the embodiments of the invention illustrated in FIGS. 1–9, the baffles 52 have been constructed with upper and lower major side surfaces of the outer sections 60 and inner sections 62 in a coplanar relationship. In the embodiment of the invention illustrated in FIGS. 10 and 11, the inner section of the baffle is disposed above and is supported by the outer section of the baffle. Since the embodiment of the invention illustrated in FIGS. 10 and 11 is generally similar to the embodiments of the invention illustrated in FIGS. 1–9, similar numerals will be utilized to designate similar components, the suffix letter "e" being associated with the numerals of FIGS. 10 and 11 to avoid confusion.

Figure 10:
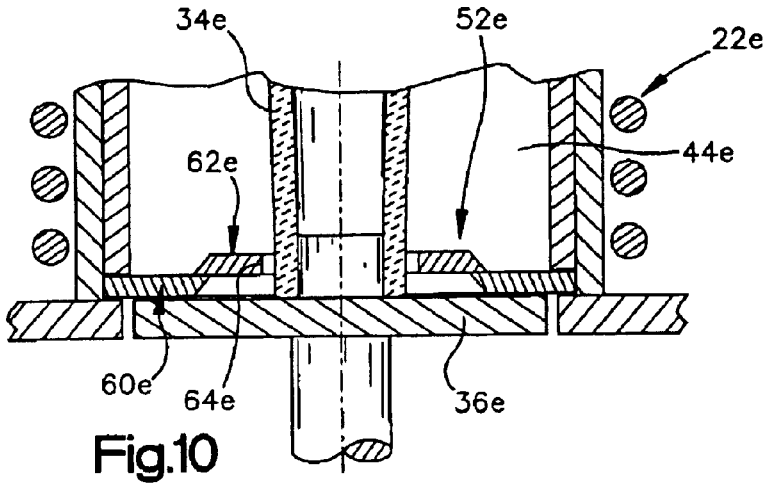
FIG. 10. is a fragmentary schematic illustration, generally similar to FIG. 1, depicting the manner in which an inner section of a baffle may be disposed above an outer section of a baffle.

A baffle 52*e* is illustrated in FIG. 10 in a furnace assembly 22*e*. The furnace assembly 22*e* has the same construction as the furnace assembly 22 of FIG. 1. A mold 34*e* extends through an opening 64*e* in a circular inner section 62*e* of the baffle 52*e*. The mold 34*e* is supported on a circular chill plate 36*e*.

In accordance with one of the features of the embodiment of the invention illustrated in FIGS. 10 and 11, the inner section 62*e* of the baffle 52*e* is disposed above and is supported by an annular outer section 60*e* of the baffle 52*e*. When the mold 34*e* is to be withdrawn from the heating chamber 44*e* in the furnace assembly 22*e* in the manner previously explained in conjunction with the embodiment of the invention illustrated in FIG. 1, an upper end portion of the mold moves downward into engagement with the inner section 62*e* of the baffle 52*e*. Force applied against the inner section 62*e* of the baffle 52*e* by the upper end portion of the mold is effective to deflect an annular inner rim 160 (FIG. 11) of the outer section 60*e*. As this occurs, the baffle 52*e* moves into and through a circular opening 130*e* formed in the outer section 60*e* of the baffle 52*e*.

The inner section 62*e* of the baffle 52*e* is then free to fall downward onto the chill plate 36*e*. The relatively large upper end portion of the mold 34*e* may then move through the relatively large circular opening 130*e* formed in the outer section 60*e*.

The circular inner section 62*e* may be placed on the upper major side surface of the outer section 60*e* without being connected to the outer section 60*e*. This would enable the lower major side surface of the inner section 62*e* to slide on the upper major side surface of the outer section 60*e*.

Alternatively, the inner section 62*e* of the baffle 52*e* may be secured to the outer section 60*e* of the baffle. This may be done with adhesive or with mechanical fasteners. Assuming that adhesive is utilized to connect the inner section 62*e* of the baffle 52*e* with the upper side of the outer section 60*e*, spaced apart bodies of adhesive may be placed on either the annular inner rim portion 160 (FIG. 11) of the outer section 60*e* on an annular rim portion 164 of the inner section 62*d*. Rather than using spaced apart bodies of adhesive, a single annular body of adhesive may be positioned on either the rim portion 160 of the outer section 60*e* or the rim portion 164 of the inner section 62*e* of the baffle 52*e*.

It is contemplated that it may be desired to install the baffle 52*e* in the furnace 22*e* by first positioning the outer section 60*e* of the baffle in the furnace assembly and then moving the inner section 62*e* through the opening 130*e* in the outer section 60*e* of the baffle. If this is to be done, notches or slots may be formed in the rim portion 160 of the outer-section 60*e* of the baffle 52*e*. The inner section 62*e* of the baffle would then be oriented with its major side surfaces extending perpendicular to the major side surfaces of the outer section 60*e* of the baffle and aligned with the notches in the rim portion 160 of the outer section 60*e* of the baffle. This would allow the inner section 62*e* of the baffle to be moved upward through the opening 130 and then moved to the orientation illustrated in FIGS. 10 and 11.

The outer section 60*e* and inner section 62*e* of the baffle 52*e* may be cut from a single piece of material. If this is done, the cut may be formed as a portion of a cone having a central axis coincident with the centers of the outer section 60*e* and inner section 62*e* of the baffle 52*e*. This results in the opening 130*e* in the outer section 60*e* of the baffle 52*e* having an axially downward and radially outward (as viewed in FIG. 11) sloping side surface. The rim portion 164 of the inner section 62*e* of the baffle 52*e* would have a radially inward and upward (as viewed in FIG. 11) slopping side surface which corresponds to the sloping side surface of the opening 130*e*.

Although the outer section 60*e* and inner section 62*e* may be formed of many different materials, they are formed of graphite felt. If desired, the outer section 60*e* and inner section 62*e* of the baffle 52*e* may have a layered construction, similar to the layered construction of FIG. 5.

In the embodiment illustrated in FIGS. 10 and 11, the inner section 62*e* of the baffle 52*e* is disposed above the outer section 60*e* of the baffle. However, if desired, the inner section 62*e* may be supported in the opening 130*e* in the outer section 60*e* baffle 52*e*. To support the inner section 62*e* of the baffle 52*e* in the opening 130*e*, the circular inner section 62*e* may be provided with radially outward projecting tabs which extend over and engage radially inward projecting tabs on the outer section 60*e*.

Latches

In the embodiment of the invention illustrated in FIGS. 1–11, the baffle 52 is supported by a base portion 86 (FIG. 1) of the furnace assembly 22. In the embodiments of the invention of the illustrated in FIGS. 12–14, the baffle is supported by latches connected with the furnace assembly. Since the embodiments of the invention illustrated in FIGS. 12–14 are generally similar to the embodiments of the invention illustrated in FIGS. 1–11, similar numerals will be utilized to designate similar components, the suffix letter "f" being associated with the embodiments of FIGS. 12 and 13.

A baffle 52*f* is disposed at a lower end portion of a furnace assembly 22*f*. A mold 34*f* has a lower end portion 48*f* which extends through an opening 64*f* formed in the baffle 52*f* into engagement with a circular chill plate 36*f*. The furnace assembly 22*f* has the same general construction as the furnace 22 of FIG. 1. The baffle 52*f* may have the same construction as any one of the baffles illustrated in FIGS. 1–11.

Figure 12:
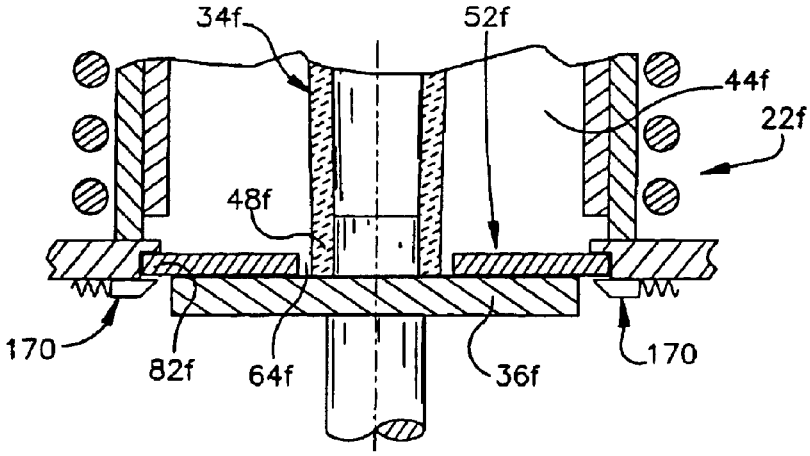
FIG. 12. is a fragmentary schematic illustration, generally similar to FIGS. 1 and 10, illustrating the manner in which latches may be utilized to retain an outer section of any one of the baffles of FIGS. 1–11 against downward movement relative to a furnace assembly.
Figure 13:
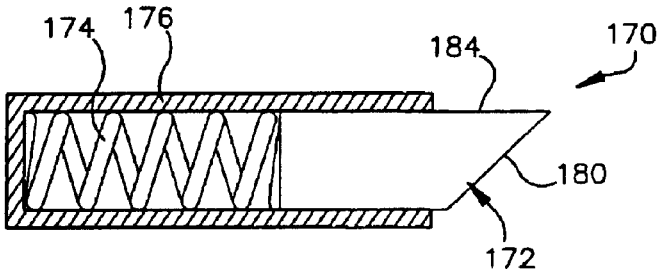
FIG. 13. is a schematic illustration of one of the latches of FIG. 12.
Figure 14:
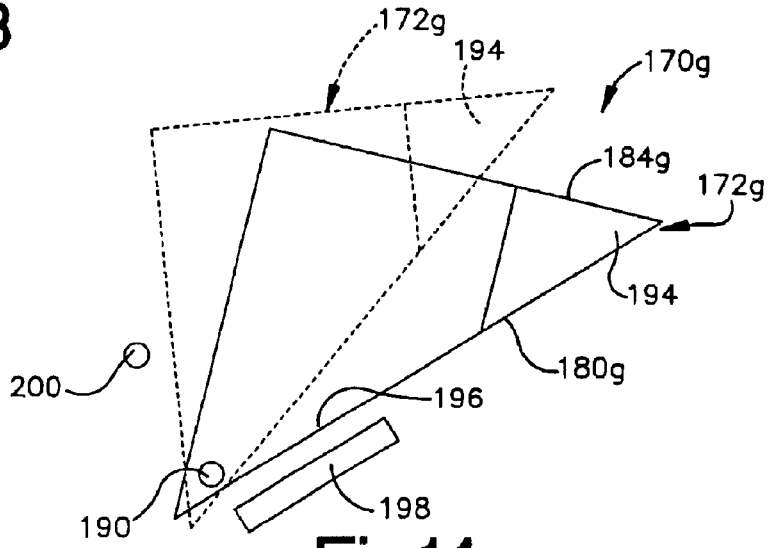
FIG. 14. is a schematic illustration of a second embodiment of a latch which may be utilized to hold a baffle against downward movement relative to a furnace assembly.

In accordance with one of the features of the embodiment of the invention illustrated in FIGS. 12 and 13, a plurality of latches 170 are arranged in a circular array at the lower end portion of the furnace assembly 22*f*. Although only two latches have been illustrated schematically in FIG. 12, it should be understood that additional latches may be provided if desired. In order to provide a stable support for the baffle 52*f*, it is believed that it may be desired to have three or more latches disposed adjacent to the lower end portion of the furnace assembly 22*f*.

When the mold 34*f* is to be positioned in the furnace assembly, the chill plate 36*f* may be lowered. The baffle 52*f* is then be placed on the upper side surface of the chill plate. The mold 34*f* may be positioned on the chill plate 36*f* with the lower end portion 48*f* of the mold extending through the opening 164*f* in the baffle 52*f*.

Once the baffle 52*f* and mold 34*f* have been positioned on the chill plate 36*f*, the chill plate is raised to move the mold into the heating chamber 44*f* of the furnace assembly 22*f*. As the chill plate 34*f* is raised, a circular outer rim portion 82*f* of the baffle 52*f* engages the latches 170. Upward force applied by the rim portion 82*f* of the baffle 52*f* is effective to operate the latches 170 to a retracted condition so that the baffle 52*f* can be moved upward past the latches 170. Once the outer rim portion 82*f* of the baffle 52*f* has moved upward past the latches 170, the latches operate to the illustrated extended condition. When the latches 170 are in a extended condition, they extend beneath the outer rim portion 82*f* of the baffle 52*f* to enable the latches to support the baffle.

When the mold 34*f* is to be withdrawn from the heating chamber 44*f*, the chill plate 36*f* is lowered in the manner previously explained. As the mold moves downward, force applied against the baffle 52*f* by relatively large upper end portion of the mold releases connectors which interconnect outer and inner sections 60 and 62 of the baffle in the manner previously explained in conjunction with the embodiments of the invention illustrated in FIGS. 1–11. This enables the inner section of the baffle 52*f* to fall downward onto the chill plate 36*f*. The upper portion of the mold 34*f* can then move through the resulting relatively large opening in the baffle 52*f*.

The latches 170 may be manually actuated to a retracted condition to release the outer section of the baffle 52*f* after the mold has been withdrawn from the furnace assembly 22*f*. The latches 170 may be manually actuated to the retracted condition by pulling on rods connected with the latches. Alternatively, the latches 170 may be actuated to the retracted condition by operating hydraulic or pneumatic motors connected with the latches.

It is contemplated that the latches 170 may have many different constructions. This specific latches 170 illustrated schematically in FIG. 12 have the construction illustrated in FIG. 13. The latch 170 includes a latch member 172 which is biased toward the extended condition illustrated in FIG. 13 by a spring 174. The latch member 172 is enclosed within a housing 176. Suitable stops extend from the housing 176 into engagement with latch member 172 to limit movement of the latch member. Alternatively, the latch member 172 may be provided with a projection which engages a slot in the housing 176 to limit movement of the latch member 172 under the influence of the spring 174.

When the baffle 52*f* and chill plate 36*f* are raised to move the mold 34*f* into the furnace assembly 22*f* in the manner previously described, the annular outer rim portion 82*f* of the baffle 52*f* moves into engagement with a cam surface 180 on the latch member 172. Force applied against the cam surface 180 by the annular outer rim portion 82*f* of the baffle 52*f* forces the latch member into the housing 176 against the influence of the spring 174. As the chill plate 36*f* and baffle 52*f* continue to be raised, the baffle moves above the latch member 172. As this occurs, the spring 174 moves the latch member from a retracted condition to the extended condition illustrated in FIG. 13.

When the chill plate 36*f* begins to move downward to withdraw the mold 34*f* from the heating chamber 44*f*, the baffle 52*f* is held against movement relative to the furnace assembly 22*f* by engagement of a lower side of the baffle with a support surface 184 on the latch member 172. This results in the baffle 52*f* being supported by the latches 170 during withdrawal of the lower portion 48*f* of the mold 34*f* from the heating chamber 44*f*.

When the upper end portion 50*f* of the mold 34*f* engages the baffle 52*f*, force is transmitted from the upper end portion of the mold 34*f* through the inner section and outer section of the baffle 52*f* to the latches 170. This enables the upper end portion of the mold to apply force against the baffle 52*f* to release the connectors in the manner previously explained herein. Releasing the connectors allows the inner section of the baffle to fall downward onto the chill plate 36*f*. The outer section of the baffle 52*f* is held in a position adjacent to the lower end portion of the heating chamber 44*f* by the latches 170.

In the embodiment of the invention illustrated in FIGS. 12 and 13, the latches 170 have spring biased latch members 172. In the embodiment of the invention illustrated in FIG. 14, the latches are gravity biased. Since the embodiment of the invention illustrated in FIG. 14 is generally similar to the embodiment of the invention illustrated in FIGS. 12 and 13, similar numerals will be utilized to identify similar components, the suffix "g" being associated with the numerals of FIG. 14.

A plurality of latches 170*g* are mounted adjacent to the lower end portion of the furnace assembly 22*f* in the manner illustrated schematically for the latches 170 in FIG. 12. The latch 170*g* includes a latch member 172*g* which is pivotally supported at 190 for movement between an extended condition illustrated in solid lines in FIG. 14 and a retracted condition in dashed lines in FIG. 14. When the latch member 172*g* is in the extended condition illustrated in solid lines in FIG. 14, a relatively heavy nose end portion 194 of the latch member 172*g* is urged downward by the effect of gravity to position a stop surface area 196 on the latch member 172*g* in engagement with a stopped member 198.

When a mold, corresponding to the mold 34*f* of FIG. 12 is to be moved into a furnace assembly corresponding to the furnace assembly 22*f*, a baffle having any one of the constructions illustrated in FIGS. 1–11 is positioned on a chill plate. The baffle and mold are then raised to move the mold into a heating chamber of the furnace assembly in the manner previously explained in conjunction with the embodiment of the invention illustrated in FIG. 12.

As the chill 36*f* plate and baffle 52*f* (FIG. 12) move upward toward the heating chamber of the furnace assembly, an annular outer rim portion 82*f* (FIG. 12) of the baffle moves into engagement with a cam surface 180*g* (FIG. 14) on the nose end portion 194 of the latch member 172*g*. The force applied against the cam surface 180*g* (FIG. 14) pivots the latch member 172*g* in a counter clockwise direction (as viewed in FIG. 14) about the pivot connection 190. A stop member 200 is provided to limit pivotal movement of the latch member 172*g* about the pivot connection 190.

As the chill plate 36*f* (FIG. 12) and baffle 52*f* continue to move upward, the circular outer rim portion 82*f* of the baffle moves above the nose end portion 194 (FIG. 14) of the latch member 172*g*. This releases the latch member 172*g* for clockwise pivotal movement from the orientation illustrated in dash lines in FIG. 14 to the orientation illustrated in solid lines in FIG. 14. As this occurs, a support surface 184*g* moves beneath the lower surface of the baffle.

When the chill plate 36*f* (FIG. 12) is subsequently lowered to withdraw the mold 34*f* from the furnace assembly 22, the baffle 52*f* moves downward onto the support surface 184*g* (FIG. 14) on the latch member 172*g*. The support surface 184*g* is skewed at an acute angle to the path of movement of the chill, plate 36*f* (FIG. 12). Therefore, the support surface 184*g* tends to center the baffle 52*f* relative to the path of movement of the chill plate 36*f*. As the chill plate 36*f* continues to be lowered, the upper end portion of the mold 34*f* engages the inner section of the baffle 52*f* and releases the connectors. As this is done, the outer section of the baffle is held stationary relative to the furnace assembly 22*f* by engagement with the support surfaces 184*g* on the latch members 172*g*.

Conclusion

In view of the foregoing description, it is apparent that the present invention provides a new and improved apparatus and method for use in casting a metal article. The apparatus may include a furnace assembly 22 having a heating chamber 44. A chill plate 36 may be provided to move a mold 34 into and out of the heating chamber 44. A baffle 52 may be utilized at a lower end portion of the heating chamber 44 to at least partially block heat flow from the heating chamber during withdrawal of the mold 34 from the heating chamber.

The baffle 52 may have an inner section 62 with an opening 64 through which the mold 34 extends when the mold is in the heating chamber 44. An outer section 60 of the baffle 52 may extend around the inner section 62 of the baffle. A plurality of connectors 70 may extend between the outer and inner sections 60 and 62 of the baffle 52 and hold them against movement relative to each other. The connectors 70 may be releasable to enable the inner section 62 of the baffle 52 to move downward relative to an outer section 60 of the baffle 52 to increase the size of an opening through which the mold, moves from the heating chamber 44.

The connectors 70 may extend between the outer and inner sections 60 and 62 of the baffle 52 and retain one or more side surfaces 76, 78, 92 and/or 94 on the outer and inner sections 60 and 62 of the baffle in a coplanar relationship when the mold 34 is in the heating chamber 44 of the furnace assembly 22. The connectors 70 may be releasable under the influence of force transmitted from the mold 34 to enable the inner section 62 of the baffle to move downward relative to the outer section 60 of the baffle 52.

The baffle 52 may be formed as one-piece (FIGS. 2–5) with the connectors 70 integrally formed as one-piece with the outer and inner sections 60 and 62 of the baffle 52. The connectors 70 may be broken under the influence of force transmitted from the mold 34 to the baffle 52 during lowering of the mold from the heating chamber 44. If desired, the outer and inner sections 60 and 62 of the baffle 52 may be separated by a plurality of slits 74 with the connectors 70 disposed between end portions of the slits 74 and formed of the same material which forms the outer and inner sections 60 and 62 of the baffle.

The outer and inner sections 60 and 62 of the baffle 52 may be formed as separate pieces (FIGS. 6–11). If this is done, the inner section 62 of the baffle may initially be disposed in an opening 130 in the outer section 60 of the baffle and held in its initial position by a plurality of connectors (70*a*, 70*b*, 70*c* or 70*d*) which extend between the outer and inner sections of the baffle. The connectors (70*a*, 70*b*, 70*c* or 70*d*) are releasable to enable the inner section (62*a*, 62*b*, 62*c* or 62*d*) of the baffle to move downward out of the opening 130 in the outer section of the baffle as the mold 34 is moved from the heating chamber 44 of the furnace assembly 22.

The inner section 52*e* (FIGS. 10 and 11) of the baffle may be disposed above and at least partially supported by the outer section 60*e* of the baffle 52*e*. If this is done, the inner section 62*e* of the baffle may be moved downward through an opening 130*e* in the outer section 60*e* of a baffle to increase the size of an opening through which the mold 34*e* is moved from the heating chamber.

Although the baffle 52 may be connected with a furnace assembly 22 in many different ways, it is believed that it may be desired to utilize latches 170 (FIGS. 12–14) to connect the baffle with the furnace assembly. The outer section 60 of the baffle 52 may be moved into engagement with and move the latches 170 during movement of the baffle into the heating chamber 44 in the furnace assembly 22. The latches 280 are effective to retain the outer section 60 of the baffle 52 against downward movement relative to the furnace assembly during movement of the mold 34 out of the heating chamber 44 in the furnace assembly 22.

The present invention has a plurality of different features which may be used together or separately. One or more of the features of the present invention may be utilized in association with one or more features of the prior art.

Having described the invention, the following is claimed:

1. An apparatus for use in casting a metal article, said apparatus comprising a furnace assembly having a heating chamber, a chill plate which is movable between raised and lowered positions and supports a mold in the heating chamber of said furnace assembly when said chill plate is in the raised position, a baffle, said baffle having an outer section which is connected with said furnace assembly and extends around an inner section of said baffle, said inner section of said baffle having an opening through which the mold extends when the mold is in the heating chamber of the furnace assembly, and a plurality of connectors which extend between said outer and inner sections of said baffle and hold said outer and inner sections of said baffle against movement relative to each other with upper side surfaces of said outer and inner sections of said baffle in a coplanar relationship when the mold is in the heating chamber of the furnace assembly, said plurality of connectors being releasable under the influence of force transmitted from the mold to enable said inner section of said baffle to move downward relative to the outer section of said baffle as the mold is lowered from the heating chamber, said side surface of said inner section of said baffle moving out of a coplanar relationship with said side surface of said outer section of said baffle as said inner section of said baffle moves downward relative to said outer section of said baffle.

2. An apparatus as set forth in claim 1 wherein said plurality of connectors are integrally formed as one-piece with said first and second sections of said baffle and are effective to hold said inner section of said baffle against movement relative to said outer section of said baffle.

3. An apparatus as set forth in claim 1 wherein said plurality of connectors include a plurality of staples, each of said staples having a first leg section which engages said outer section of said baffle, a second leg section which engages said inner section of said baffle, and a connector section which extends between said first and second leg sections and extends along said side surfaces of said outer and inner sections of said baffle when said side surfaces of said outer and inner sections of said baffle are in the coplanar relationship.

4. An apparatus as set forth in claim 1 wherein said plurality of connectors include at least one body of adhesive which engages said inner and outer sections of said baffle and transmits force which retains said outer and inner sections of said baffle against relative movement.

5. An apparatus as set forth in claim 4 wherein said at least one body of adhesive is at feast partially disposed in an opening in said outer section of said baffle.

6. An apparatus as set forth in claim 4 wherein said at least one body of adhesive is at least partially disposed in engagement with side surfaces of said outer and inner sections of said baffle.

7. An apparatus as set forth in claim 4 wherein said at least one body of adhesive is at least partially disposed in engagement with the side surfaces of said outer and inner sections of said baffle which are disposed in a coplanar relationship.

8. An apparatus as set forth in claim 1 wherein said inner and outer sections of said baffle are separated by a plurality of slits, said plurality of connectors being at least partially disposed between end portions of slits of said plurality of slits.

9. An apparatus as set forth in claim 1 wherein said baffle includes first and second layers of material, said connectors include at least a portion of at least one of said layers of material.

10. An apparatus as set forth in claim 1 wherein said connectors are at least partially formed by material which extends between said outer and inner sections of said baffle, said connectors being breakable under the influence of force transmitted from the mold to said inner section of said baffle to release said inner section of said baffle for movement relative to said outer section of said baffle.

11. An apparatus as set forth in claim 1 wherein an opening in said outer section of said baffle is only partially formed prior to transmission of force from the mold to said inner section of said baffle and release of said connectors, material of said baffle being torn upon release of said connectors to complete formation of the opening in said outer section of said baffle.

12. An apparatus as set forth in claim 1 wherein said plurality of connectors are at least partially formed by a plurality of breakable rods which extend between said outer and inner sections of said baffle, said rods being breakable under the influence of force transmitted from the mold.

13. An apparatus as set forth in claim 1 wherein said connectors include a plurality of members which extend between said outer and inner sections of said baffle, said plurality of members having central axes which extend generally parallel to the coplanar side surfaces of said outer and inner sections of said baffle.

14. An apparatus as set forth in claim 13 wherein the plurality of members include staples having sections with central axes which extend generally parallel to the coplanar side surfaces of said outer and inner sections of said baffle.

15. An apparatus as set forth in claim 13 wherein said plurality of members are breakable under the influence of force transmitted from the mold.

16. An apparatus as set forth in claim 13 wherein said plurality of members are disposed in engagement with said outer and inner sections of said baffle when said side surfaces of said outer and inner sections of said baffle are in a coplanar relationship, said plurality of members being disengaged from at least one of said outer and inner sections of said baffle during movement of the mold from the raised position to the lowered position.

17. An apparatus as set forth in claim 1 further including a plurality of latches connected with said furnace assembly and engagable with said outer section of said baffle to retain said outer section of said baffle against downward movement relative to the said furnace assembly during downward movement of said chill plate toward the lowered position.

18. An apparatus for use in casting a metal article in a mold, said apparatus comprising a furnace assembly having a heating chamber, a chill plate which is movable between raised and lowered positions and which supports the mold in the heating chamber of said furnace assembly when said chill plate is in the raised position, and a one-piece baffle which is connected with said furnace assembly and which includes first and second sections interconnected by a plurality of connector sections which are integrally formed as one-piece with said first and second sections of said baffle, said connector sections of said baffle being breakable under the force transmitted from the mold to said baffle during lowering of said chill plate to move the mold from the heating chamber.

19. An apparatus as set forth in claim 18 wherein said first and second sections of said baffle are separated by a plurality of slits formed in said baffle, said connector sections being disposed between end portions of slits of said plurality of slits.

20. An apparatus as set forth in claim 18 wherein said baffle includes first and second layers of material, said first and second sections of said baffle being separated by a plurality of sets which extend through said first and second layers of material, said first layer of material being severed at said connector sections of said baffle, said second layer of material extends from said first section of said baffle to said second section of said baffle at said connector sections of said baffle.

21. An apparatus as set forth in claim 18 wherein said first section of said baffle has an annular configuration and circumscibes said second section of said baffle, said first section of said baffle having a circular outer rim portion which is connected with said furnace assembly, said second section of said baffle having a circular rim portion which is connected with a circular inner rim portion of said first section of said baffle by said connector sections.

22. An apparatus as set forth in claim 21 wherein said second section of said baffle includes a opening through which the mold extends when the mold is in the heating chamber of the furnace assembly.

23. An apparatus as set forth in claim 18 further including a plurality of latches which engage said first section of said baffle to block downward movement of said first section of said baffle during breaking of said connector sections of said baffle.

24. An apparatus as set forth in claim 18 wherein said first and second sections of said baffle have side surfaces which are disposed in a coplanar relationship.

25. An apparatus as set forth in claim 18 further including a plurality of latches connected with said furnace assembly and engagable with said first section of said baffle during upward movement of said chill plate, said latches being effective to retain said first section of said baffle against downward movement relative to said furnace assembly during downward movement of said chill plate toward the lowered position.

26. An apparatus for use in casting a metal article in a mold, said apparatus comprising a furnace assembly having a heating chamber, a chill plate which is movable between raised and lowered positions and which supports the mold in the heating chamber of said furnace assembly when said chill plate is in the raised position, a baffle, said baffle having an outer section which is connected with said furnace assembly and an inner section which is disposed within an opening in said outer section of said baffle with upper side surfaces of said outer section and inner section in a coplanar relationship, said inner section of said baffle having an opening through which the mold extends when said chill plate is in the raised position, and a plurality of connector members which extend between said outer and inner sections of said baffle and transmit force to maintain said inner section of said baffle in said opening in said outer section of said baffle, said connector members being releasable under the influence of force transmitted from the mold to said inner section of said baffle to enable said inner section of said baffle to move downward out of the opening in said outer section of said baffle as said chill plate and the mold are lowered from the raised position toward the lowered position.

27. An apparatus as set forth in claim 26 wherein said connector members are breakable under the influence of force transmitted from the mold to said inner section of said baffle.

28. An apparatus as set forth in claim 26 wherein each connector member of said plurality of connector members includes first and second end portions which are interconnected by an intermediate portion, said first end portion of each connector member of said plurality of connector members being disposed in engagement with said outer section of said baffle, said second end portion of each connector member of said plurality of connector members being disposed in engagement with said inner section of said baffle, said intermediate portion of each connector member of said plurality of connector members extends along side surfaces of said outer and inner sections of said baffle when said inner section of said baffle is in said opening in said outer section of said baffle.

29. An apparatus as set forth in claim 28 wherein said first and second end portions of each connector member extend transverse to said central portion of each connector member.

30. An apparatus as set forth in claim 26 wherein each connector member of said plurality of connector members has first and second end portions which engage said outer section of said baffle and an intermediate portion which is disposed between said first and second end portions and engages said inner section of said baffle.

31. An apparatus as set forth in claim 30 wherein said connector members are breakable under the influence of force transmitted from the mold to said inner section of said baffle to release said connector members and enable said inner section of said baffle to move downward out of the opening in said outer section of said baffle.

32. An apparatus as set forth in claim 30 wherein each of said connector members is formed by a rod of ceramic material.

33. An apparatus as set forth in claim 26 wherein at least some of said connector members extend between said baffle and said furnace assembly to support said baffle in said furnace assembly.

34. An apparatus set forth in claim 26 further including a plurality of latches connected with said furnace assembly and engageable with said outer section of said baffle to retain outer section of said baffle against downward movement relative to said furnace assembly during at least a portion of the downward movement of said chill plate toward the lowered position.

35. An apparatus as set forth in claim 26 wherein said outer and inner sections of said baffle have side surfaces which are in a coplanar relationship when the inner section of said baffle is in said opening in said outer section of said baffle.

36. An apparatus as set forth in claim 26 wherein plurality of connector members include adhesive which engages said outer and inner sections of said baffle and transmits force which retains said outer and inner sections of said baffle against relative movement.

37. An apparatus as set forth in claim 26 wherein said plurality of connector members include a plurality of bodies of adhesive which are at least partially disposed in the opening in said outer section of said baffle and are effective to transmit force which retains said inner section of said baffle in the opening in said outer section of said baffle.

38. An apparatus as set forth in claim 26 wherein said plurality of connector members include a plurality of bodies of adhesive which are at least partially disposed in engagement with side surfaces of said outer and inner sections of said baffle.

39. An apparatus set forth in claim 26 wherein said plurality of connector members include a plurality of bodies of adhesive which are at least partially disposed in engagement with side surfaces of said outer and inner sections of said baffle which are disposed in a coplanar relationship.

40. An apparatus for use in casting a metal article, said apparatus comprising a furnace assembly having a heating chamber, a chill plate which is movable between raised and lowered positions and supports the mold in the heating chamber of said furnace assembly when said chill plate is in the raised position, a baffle, said baffle having an outer section which is connected with said furnace assembly and extends around an inner section of said baffle, said inner section of said baffle having an opening through which the mold extends when the mold is in the heating chamber of the furnace assembly, and a plurality of connectors which extend between said outer and inner sections of said baffle and hold said outer section of said baffle against movement relative to said inner section of said baffle, said baffle is formed of one piece of material which extends from said outer section of said baffle through said plurality of connectors to said inner section of said baffle, said plurality of connectors being releasable under the influence of force transmitted from the mold to enable said inner section of said baffle to move downward relative to the outer section of said baffle as the mold is lowered from the heating chamber.

41. An apparatus as set forth in claim 40 wherein said plurality of connectors retain side surfaces of said outer and inner sections of said baffle in a coplanar relationship with side surfaces of said connectors.

42. An apparatus as set forth in claim 40 wherein said outer and inner sections of said baffle are formed by a plurality of layers which include said one piece of material.

43. An apparatus for use in casting a metal article, said apparatus comprising a furnace assembly having a heating chamber, a chill plate which is movable between raised and lowered positions and supports the mold in the heating chamber of said furnace assembly when said chill plate is in the raised position, a baffle, said baffle having an outer section which is connected with said furnace assembly and extends around an inner section of said baffle, said inner section of said baffle having an opening through which the mold extends when the mold is in the heating chamber of the furnace assembly, and a plurality of connectors which extend between said outer and inner sections of said baffle and hold said outer and inner sections of said baffle against movement relative to each other, said baffle consists of one piece of material which extends from said outer section of said baffle through said plurality of connectors to said inner section of said baffle, said plurality of connectors being releasable under the influence of force transmitted from the mold to enable said inner section of said baffle to move downward relative to the outer section of said baffle as the mold is lowered from the heating chamber.

44. An apparatus for use in casting a metal article, said apparatus comprising a furnace assembly having a heating chamber, a chill plate which is movable between raised and lowered positions and supports a mold in the heating chamber of said furnace assembly when said chill plate is in the raised position, a baffle, said baffle having outer and inner sections, and a plurality of connectors which extend between said outer and inner sections of said baffle and hold said outer and inner sections of said baffle against movement relative to each other, said plurality of connectors being integrally formed as one piece with said outer and inner sections of said baffle, said plurality of connectors being releasable under the influence of force transmitted from the mold to enable said inner section of said baffle to move downward relative to the outer section of said baffle as the mold is lowered from the heating chamber.

45. An apparatus as set forth in claim 44 wherein said outer and inner sections of said baffle are separated by a plurality of slits, said plurality of connectors being at least partially disposed between end portions of silts of said plurality of slits.

46. An apparatus as set forth in claim 44 wherein said baffle includes first and second layers of material, said connectors include at least a portion of at least one of said layers of material.

47. A method of casting a metal article, said method comprising the steps of connecting a baffle with a furnace assembly, retaining upper side surfaces of outer and inner sections of the baffle in a coplanar relationship with each other, said step of retaining side surfaces of outer and inner of the baffle in said coplanar relationship includes transmitting force through a plurality of connectors which extend between the outer and inner sections of the baffle, withdrawing a mold from the furnace assembly, releasing the plurality of connectors under the influence of force applied against the baffle by the mold as the mold is withdrawn from the furnace assembly, and moving the inner section of the baffle relative to the outer section of the baffle as the mold continues to be withdrawn from the furnace assembly after releasing the plurality of connectors.

48. A method as set forth in claim 47 further including the step of supporting the mold on a chill plate with the mold extending through the baffle into the furnace assembly while the baffle is connected with the furnace assembly and while the side surfaces of the outer and inner sections of the baffle are in the coplanar relationship, said step of withdrawing the mold from the furnace assembly includes moving the chill plate and mold downward away from the furnace assembly.

49. A method as set forth in claim 47 wherein the connectors are integrally formed as one piece with the outer and inner sections of the baffle, said step of releasing the plurality of connectors includes releasing the plurality of connectors with a tearing action.

50. A method as set forth in claim 47 wherein the connectors are integrally formed as one piece with the outer and inner sections of the baffle, said step of releasing the plurality of connectors includes releasing the plurality of connectors with a snapping action.

51. A method as set forth in claim 47 wherein each connector of the plurality of connectors includes a staple having a first leg section which engages the outer section of the baffle and a second leg section which engages the inner section of the baffle, said step of releasing the plurality of connectors includes disconnecting at least one of the leg sections of each of the staples from a section of the baffle.

52. A method as set forth in claim 47 wherein each connector of the plurality of connectors includes at least one body of adhesive which engages the inner and outer sections of the baffle, said step of releasing the plurality of connectors includes disconnecting the bodies of adhesive from a section of the baffle.

53. A method as set forth in claim 47 wherein the connectors are at least partially formed by material which extends between the outer and inner sections of the baffle, said step of releasing the plurality of connectors includes breaking the plurality of connectors.

54. A method as set forth in claim 47 wherein the plurality of connectors include a plurality of rods which extend between the outer and inner sections of the baffle, said step of releasing the plurality of connectors includes breaking the plurality of rods.

55. A method as set forth in claim 47 wherein said step of connecting the baffle with the furnace assembly includes engaging the outer section of the baffle with a plurality of latches, said step of moving the inner section of the baffle relative to the outer section of the baffle is at least partially performed while engaging the outer section of the baffle with the plurality of latches.

* * * * *

UNITED STATES PATENT AND TRADEMARK OFFICE

CERTIFICATE OF CORRECTION

PATENT NO. : 6,698,493 B2
DATED : March 2, 2004
INVENTOR(S) : Lawrence D. Graham It is certified that error appears in the above-identified patent and that said Letters Patent is hereby corrected as shown below:

Column 23,
Line 38, after “at” change “feast” to -- least --.

Column 24,
Line 58, after “of” change “sets” to -- slits --.

Column 27,
Line 54, after “of” change “silts” to -- slits --.

Column 28,
Lines 2-3, after “inner” insert -- sections --.

Signed and Sealed this

Eighteenth Day of January, 2005

JON W. DUDAS
*Director of the United States Patent and Trademark Office*